US007856728B1

(12) United States Patent
Ozinga

(10) Patent No.: US 7,856,728 B1
(45) Date of Patent: Dec. 28, 2010

(54) ADJUSTABLE SCOPE MOUNTING FOR ARCHERY BOWS

(76) Inventor: Robert Ozinga, 236 Fortenberry Creek Rd., Blairsville, GA (US) 30512-7059

( * ) Notice: Subject to any disclaimer, the term of this patent is extended or adjusted under 35 U.S.C. 154(b) by 0 days.

(21) Appl. No.: 12/592,316

(22) Filed: Nov. 23, 2009

(51) Int. Cl.
*F41G 1/467* (2006.01)

(52) U.S. Cl. ..... 33/265; 124/87

(58) Field of Classification Search ..... 33/265; 124/87
See application file for complete search history.

(56) References Cited

U.S. PATENT DOCUMENTS

| | | | | |
|---|---|---|---|---|
| 2,542,501 | A | 2/1951 | Fredrickson | |
| 3,266,149 | A | 8/1966 | Powell | |
| 4,291,469 | A | 9/1981 | Weast | |
| 4,294,017 | A | 10/1981 | Byrnes | |
| 4,497,116 | A | 2/1985 | Hawkins | |
| 4,961,265 | A | 10/1990 | Roberts | |
| 5,092,053 | A | 3/1992 | Roberts | |
| 5,117,804 | A * | 6/1992 | Jorlov | 124/87 |
| 5,442,862 | A * | 8/1995 | Newbold et al. | 33/265 |
| 5,511,317 | A * | 4/1996 | Allen | 33/265 |
| 5,524,351 | A * | 6/1996 | Pinson et al. | 33/265 |
| 5,651,185 | A * | 7/1997 | Vanderheyden et al. | 33/265 |
| 5,718,215 | A * | 2/1998 | Kenny et al. | 124/87 |
| 5,920,996 | A * | 7/1999 | Hurckman et al. | 33/265 |
| 6,061,919 | A * | 5/2000 | Reichert | 33/265 |
| 6,644,297 | B1 | 11/2003 | Brown, Jr. | |
| 6,868,614 | B2 * | 3/2005 | Floied et al. | 33/265 |
| 6,895,676 | B1 | 5/2005 | Mendyk | |
| 7,475,485 | B1 * | 1/2009 | Hamm et al. | 33/265 |
| 7,513,050 | B2 * | 4/2009 | Kroening, Jr. | 33/265 |
| 7,584,543 | B1 * | 9/2009 | Boyd | 33/265 |
| 7,644,503 | B2 * | 1/2010 | Lewis | 33/265 |

* cited by examiner

*Primary Examiner*—Christopher W Fulton
(74) *Attorney, Agent, or Firm*—John M. Taboada

(57) ABSTRACT

A converging lines of sight mount which utilizes handgun type scopes. It provides for elevation, windage and draw length adjustments. It features a graduated range scale with highly discernable graduations each representing less than one yard. It is constructed for mounting on a bow forward of the archer, having two forward facing oscillating arms with integral gears. A linkage connects both arms at one end and a pinion imparts synchronized motion at the opposite end. Said arms arc lengths, being dissimilar, impart a tilting motion to the linkage. Said tilting provides for converging lines of sight at the archer's eye at any elevation setting. Said converging point equates to draw length and is adjustable by means of an offset rotary device which alters the arm length ratio between arms. An effective windage adjustment provides in excess of 240 inches at 100 yards with a resolution of approximately 2 inches.

17 Claims, 7 Drawing Sheets

FIG. 2
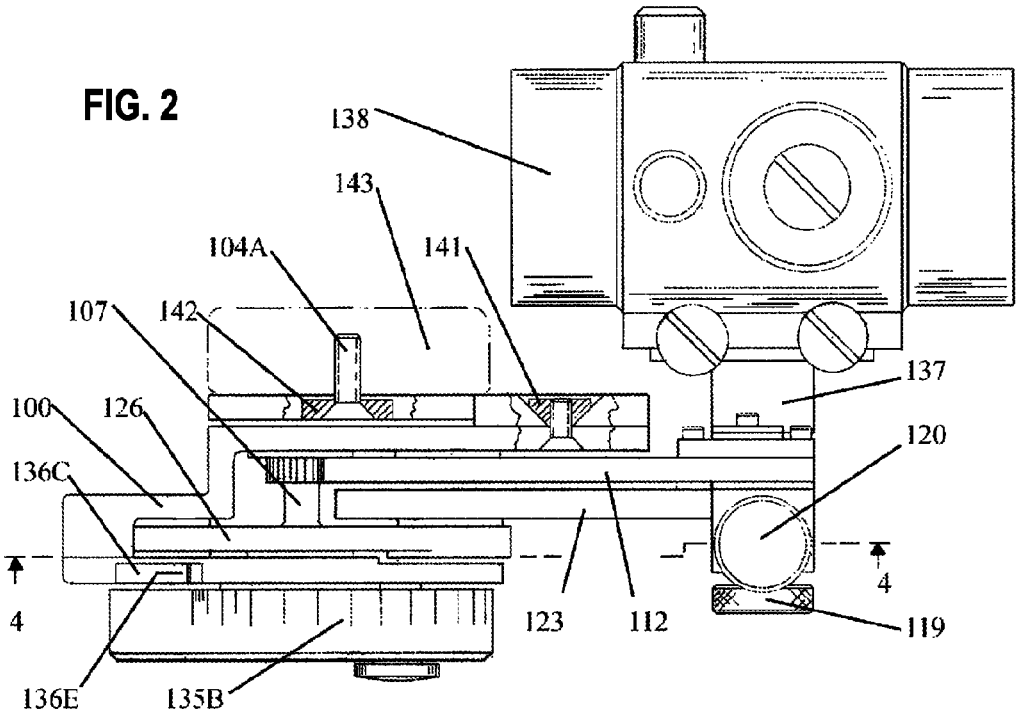
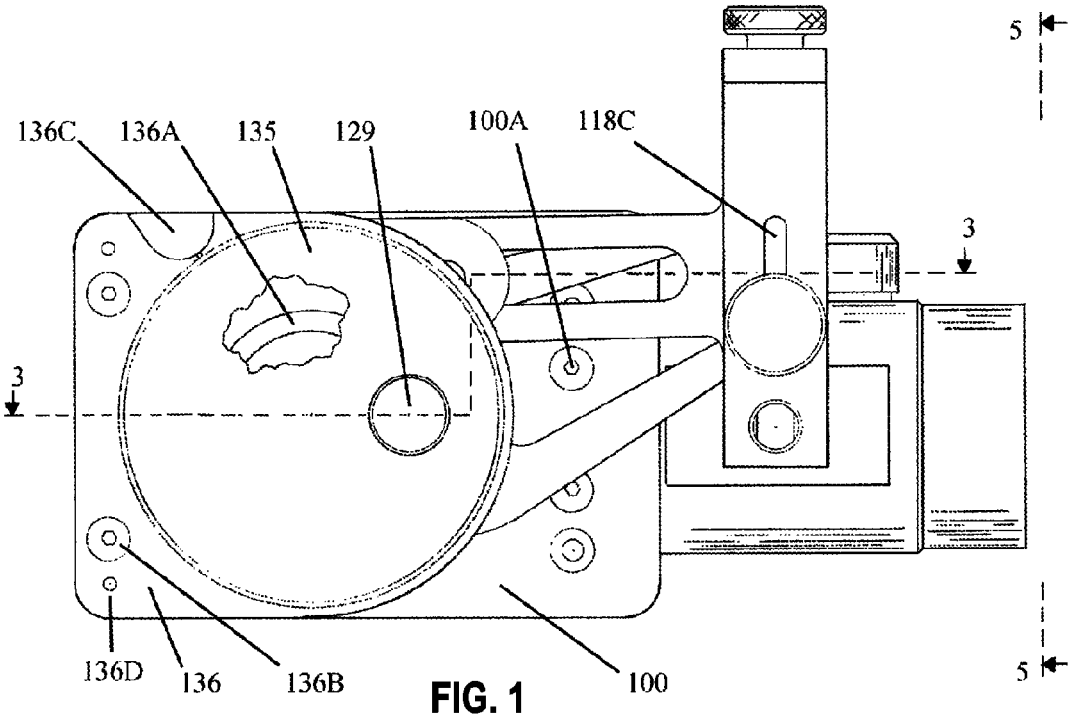
FIG. 1

ADJUSTABLE SCOPE MOUNTING FOR ARCHERY BOWS

I. BACKGROUND

The invention relates generally to the field of archery bow mounts for scopes and reflex sights, specifically those mounts with range adjustment incorporating converging lines of sight. Currently, the market favors an arrangement that utilizes a front sight with three horizontal pins staked vertically and a rear peep sight mounted on the bow shooting string. The shooting string is the entirety of the string in a regular style bow or, on a compound style bow, the specific portion of the string from cam to cam or cam to limb that propels the arrow. Proper stance and consistent anchor point are a crucial part of the equation. The anchor point is a specific point to which the nock of the arrow is drawn prior to release. The archer may use as reference a finger to the corner of the mouth, a bow string to the tip of the nose, a part of the hand to a part of the jaw or any other suitable feature to the point. In said arrangement, the front sight horizontal pins provide for range and are adjustable for windage. The anchor point provides for a reference point to where to vertically mount the peep sight on the bow shooting string and when the bow is drawn, to place automatically the peep hole in line with the archer's eye. The anchor point is to a bow what the stock is to a shotgun. This triangular combination provides for quick acquisition of the line of sight in relation to the target, which is critical for hunting. It should be noted that one strong point of this design is being specific to each individual archer. After the initial set-up, an archer could feasibly grasp his bow, take a proper stance, close the eyes, draw the bow to the anchor point and, upon opening the eyes, find the aiming eye looking right through the peep hole and seeing the front sight aligned within the orifice of the peep sight. The three pin front sight represents three different ranges, close, medium, and long. With an average arrow trajectory of 14 feet at 70 yards, said three pins leave large amounts of yardage uncovered. Thus, after estimating the distance to the target, the archer must choose a corresponding pin and then decide whether to hold dead on, above, or below said pin and, if that is the case, by how much. More pins will only lead to confusion due to the space available. Fourteen feet at 70 yards represents about 2 inches at the location of the front sight. Many pins are required to cover a reasonable and significant number of range points. Most of these pins will be crammed within the very last portion of the available 2 inches due to the fact that most of the 14 feet trajectory will be at the end of said trajectory.

Due to the proximity to the eye, the rear peep sight blocks much needed light under most common hunting situations and it obscures a significant portion of the target. The shooting bow string twists and stretches as it settles and the peep sight, being attached to it, rotates and moves vertically out of alignment. Additionally, the peep sight needs to be replaced every time the string is replaced and, therefore, the time consuming task of zero-in must also be performed.

Zero or low magnification long eye relief scopes and reflex sights have significant potential in the field of archery but none of the current designs have met with market approval. With the proper mount, their potential revolves around a) eliminating the limiting front sight, b) eliminating the troublesome rear peep sight, c) eliminating the need for aligning the target with the front and rear sights while attempting to focus the aiming eye in one, and d) offering the option of magnification.

A mount that utilizes zero or low magnification long eye relief scopes and reflex sights potential must address the most important limitation of these sights. A scope has an extremely narrow line of sight due to their small exit pupil and a mount that utilizes said sights must provide for user-friendly means to minimize this burden. Said mount must also address the fact that it is attempting to replace, for all practical purposes, a custom made setup. Failing to provide for the retention of anchor point is failing to address the custom made relationship of peep sight to eye.

State of the art adjustable range mounts for scopes fail to provide overall significant improvement over the three pin and peep sight arrangement. Said mounts generally fall short in one or more features that said arrangement delivers. A scope mount should provide at least the following features in order to compete and succeed in the market place: 1) Continuous eye alignment regardless of elevation setting or draw length. The draw length is the distance, in inches, from the top back side of the bow handle to the nock of the arrow when the arrow is held within a fully drawn bow. These combined elements are missing in all current scope mount designs. This is crucial to the performance of the mount and, as such, for market acceptance. Failure to provide continuous eye alignment necessitates a change of anchor point for any given elevation setting. Changing anchor point makes target and reticle acquisition through the scope very difficult due to the scope's narrow field of view. 2) An adjustment for windage. The internal windage adjustment provided by scopes does not have sufficient range to account for anomalies found in most mounting surfaces of bows. 3) A graduated scale large enough to allow for a large number of easily discernable graduations covering all distances within a useful range. 4) Be free from interference from any part of the bow. 5) Be relatively compact. 6) Be user friendly. 7) Be relatively simple.

Patents have been issued for scope mounts, but they all fall short of the above criteria. In U.S. Pat. No. 4,294,017 issued to Brynes et al., the alignment with archer's eye throughout elevation adjustment is achieved at only one specific draw length as determined by the curvature of the solid track. Archer's with other draw length must adjust anchor point to the specific elevation setting. Additionally, it does not provide for windage adjustment and the location of the mount behind the bow may interfere with some state of the art compound bow parts, specifically the string cable bar. In a compound bow, the cable bar maintains the non-shooting portion of the string to one side of the arrow shaft. The cable bar normally is positioned on the back side of the bow and in the proximity of the arrow window. In U.S. Pat. No. 4,961,265 issued to Roberts, the mount does not maintain eye alignment throughout the elevation adjustment and requires that the archer change anchor point significantly as elevation is adjusted. It also does not provide for windage adjustment. In U.S. Pat. No. 5,092,053 issued to Roberts, alignment with the archer's eye throughout elevation changes is achieved at only one specific draw length as determined by the curvature designed into the solid track, therefore, archers with different draw lengths must change anchor point every time elevation settings change. The mounts disclosed in U.S. Pat. No. 6,644,297 issued to Brown and in U.S. Pat. No. 6,895,676 issued to Mendyk also fail to meet all of the above criteria.

Patents have also been issued for open sight mounts, but they too all fall short of the above criteria. In U.S. Pat. No. 2,542,501 issued to Fredrickson, the mount for open sights offers converging lines of sight at only one specific draw length due to the hard curved track and modification of bow is not practical. In U.S. Pat. No. 4,497,116 issued Hawkins, the mount is designed for open front and rear sights and offers converging lines of sight, however, it does not provide for draw length adjustment or windage adjustment. It is also complex and may interfere with parts of current bow technologies. In U.S. Pat. No. 7,584,543 issued to Boyd, the mount is for front and rear sights. It is not user friendly since it will be most difficult for the archer to adjust for draw length while attempting to judge the speed differential between the front and rear sight while holding the bow with proper stance at draw length without the steadying benefit of drawing the bow. Additionally, the second hand is required to operate the mount. Finally, the placement of the rear sight behind the bow may interfere with the string cable bar of most state of the art compound bows.

The embodiment or embodiments described herein may solve these shortcomings as well as others by proposing a novel adjustable scope sight mount device that provides converging lines of sight.

II. SUMMARY

It is the object of this invention to provide an archery bow sight mount for scopes which enables archers to maintain eye position and anchor point at any of a plurality of draw lengths at any reasonable archery bow range setting. Accordingly, the objectives and advantages of my invention include: 1) Provide a mount for archery bows sights that utilize scope or reflex sights which contain a simple, effective, accurate and user friendly adjustment for a plurality of bow draw lengths and to, additionally, provide converging lines of sight at all available elevation adjustments at any of said plurality of draw lengths enabling archers to benefit from a proper stance and a constant anchor point. 2) Provide a mechanism for elevation that, through mechanical advantage, significantly expands the two inch vertical space normally available at the bow, thus enabling archers to set a plurality of setting to any previously selected distance within normal shooting distances. 3) Provide a user friendly clearly legible graduated scale whereby the archer can clearly and accurately identify and set distances at approximately one yard increments. 4) Provide a simple, user friendly, and effective windage adjustment that can discern approximately one inch at one hundred yards. 5) Provide an adapter plate that will increase the versatility of the mount. 6) Provide a mount which will place the scope sight in a space normally free of bow elements. 7) Provide an initial coarse vertical adjustment to roughly align the scope with the archer's eye at the time of attaching the mount to the bow. 8) Provide a final precision vertical adjustment for aligning the line of sight of the scope with the archer's eye during initial setup.

Numerous additional embodiments are also possible.

III. BRIEF DESCRIPTION OF THE DRAWINGS

Other objects and advantages of the invention may become apparent upon reading the detailed description and upon reference to the accompanying drawings.

In the drawings, closely related figures or features may have the same number but different alphabetic suffixes.

FIG. 1 is a plan view with applicable elements set at minimum range and the slide fully retracted, in accordance with some embodiments.

FIG. 2 is an elevation view of FIG. 1, in accordance with some embodiments.

REFERENCE NUMERALS IN DRAWINGS

Figure 4:
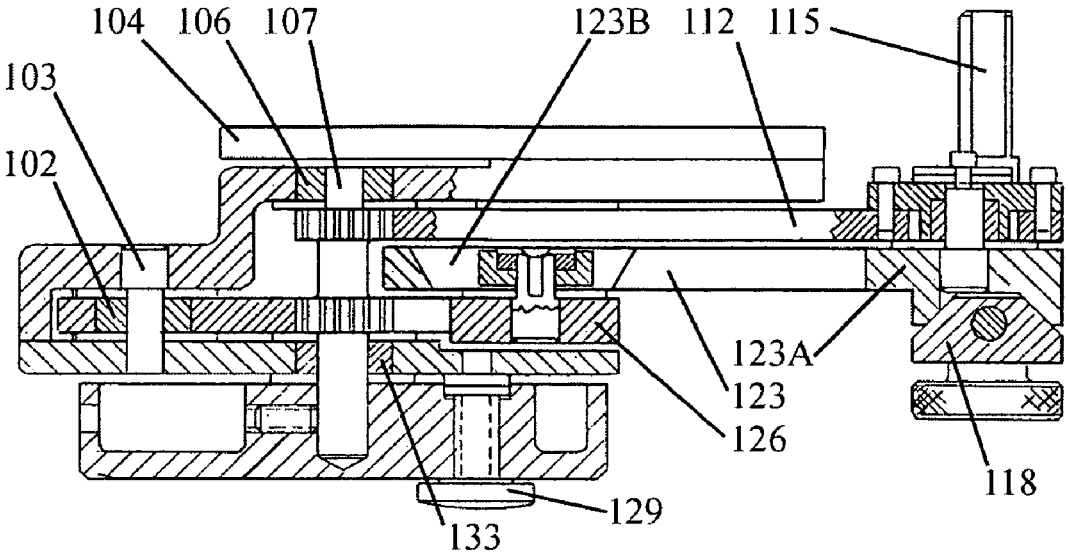
FIG. 4 is a cross section view of FIG. 2 through line 4-4, in accordance with some embodiments.

| | |
|---|---|
| 100 | Base |
| 100A | Flat head screw |
| 101 | Rear arm spacer |
| 102 | Rear arm bearing |
| 103 | Rear arm pivot post |
| 104 | Bow adapter plate |
| 104A | Flat head screw |
| 104B | Vertical slot |
| 104C | Horizontal slot |
| 105 | Double pinion base spacer |
| 106 | Small double pinion bearing |
| 107 | Double pinion |
| 107A | Pinion teeth |
| 108 | Front arm frame spacer |
| 109 | Flat head screw |
| 110 | Slider post cap |
| 111 | Slider resilient washer |
| 112 | Front arm |
| 112A | Front arm teeth |
| 112B | Pointer |
| 113 | Offset housing |
| 113A | Cap head screw |
| 114 | Offset bearing post cap |
| 115 | Slide extension shaft |
| 116 | Resilient washer |
| 117 | Offset housing bearing |
| 118 | Tower slide |
| 118A | Set screw |
| 118B | Extension shaft pin |
| 118C | Slot |
| 119 | Tower slide lock |
| 120 | Slide thumbscrew |
| 120A | Retainer |
| 121 | Offset housing post |
| 121A | cap head screw |
| 122 | Front link spacer |
| 123 | Link |
| 123A | Link tower |
| 123B | Wedge slot |
| 124 | Wedge slider |
| 125 | Rear link spacer |
| 126 | Rear arm |
| 126A | Rear arm teeth |
| 127 | Slider post |
| 128 | Lock resilient washer |
| 129 | Hand knob lock |
| 130 | Backup plate |
| 131 | Double pinion cover spacer |
| 132 | Hand knob spacer |
| 133 | Large double pinion bearing |
| 134 | Rear arm cover spacer |
| 135 | Hand knob |
| 135A | Set screw |
| 135B | Graduated scale |
| 136 | Cover |
| 136A | Semicircular slot |

-continued

| | |
|---|---|
| 136B | Flat head screw |
| 136C | Elevation window |
| 136D | Dowel pin |
| 136E | Groove |
| 137 | Scope adapter |
| 137A | Set screw |
| 138 | Scope |
| 139 | Front arm pivot post |
| 139A | Retainer ring |
| 140 | Front arm bearing |
| 141 | Double nut |
| 142 | Elongated screw adapter |
| 143 | Bow |
| 144 | Simple link |
| 145 | Back arm |
| 145A | Back arm teeth |
| 145B | Back arm extension |
| 146 | Long link |
| 147 | Forward arm |
| 147A | Forward arm teeth |
| 148 | Front plate |
| 149 | Rear plate |

While the invention is subject to various modifications and alternative forms, specific embodiments thereof are shown by way of example in the drawings and the accompanying detailed description. It should be understood, however, that the drawings and detailed description are not intended to limit the invention to the particular embodiments. This disclosure is instead intended to cover all modifications, equivalents, and alternatives falling within the scope of the present invention as defined by the appended claims.

IV. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

Figure 3:
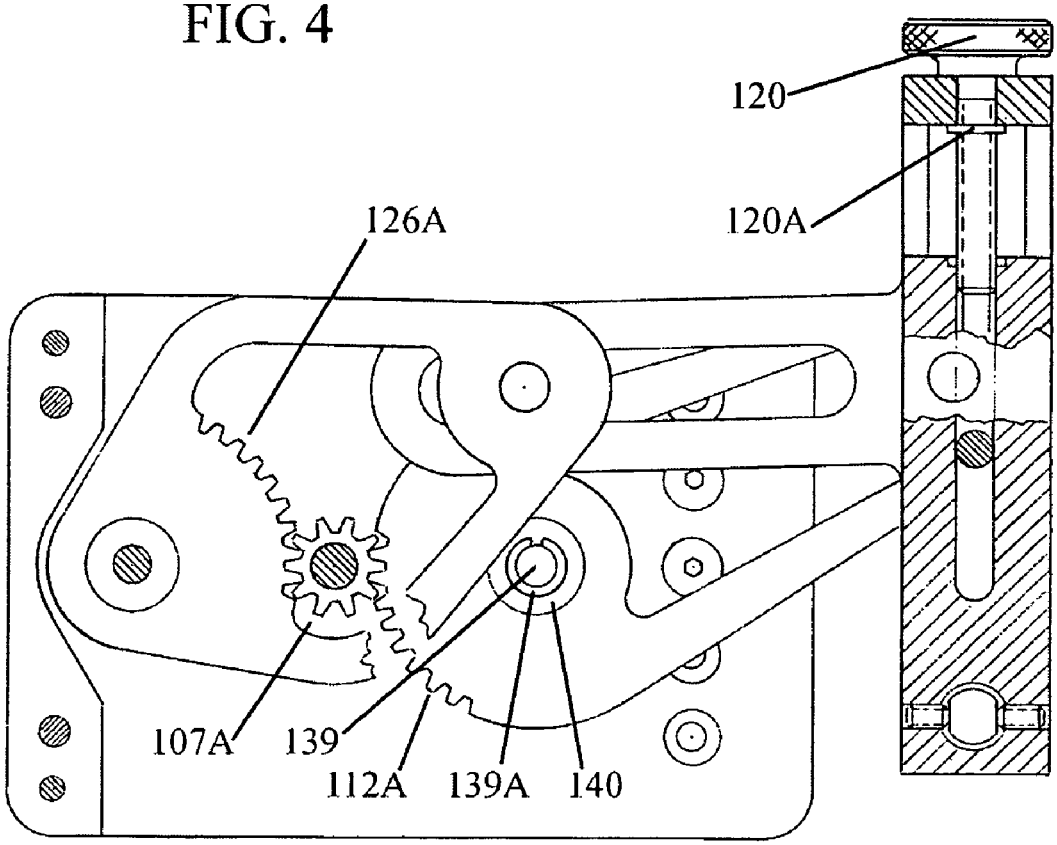
FIG. 3 is a cross section view of FIG. 1 through line 3-3 and with the slide extended, in accordance with some embodiments.
Figure 4A:
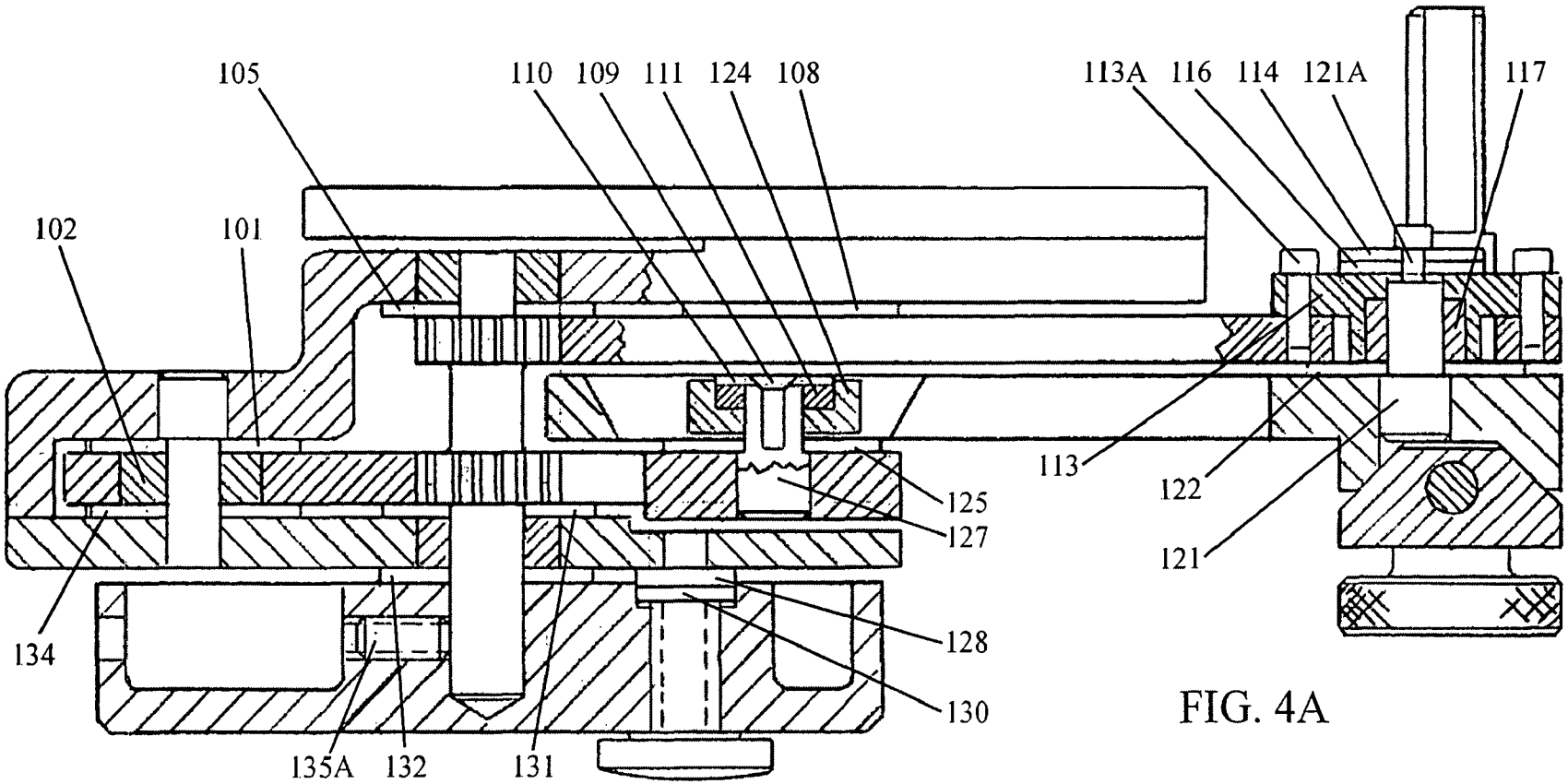
FIG. 4A is an enlarged view of FIG. 4, in accordance with some embodiments.
Figure 6:
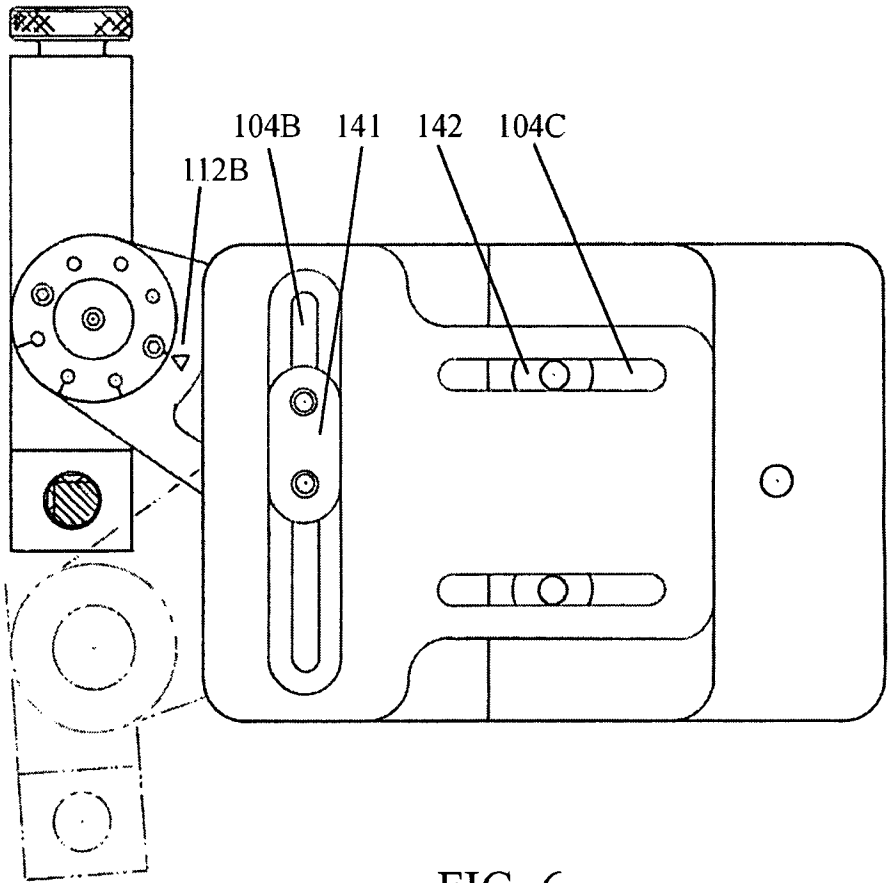
FIG. 6 is the back side of FIG. 1 and an alternate position of the scope, in accordance with some embodiments.
Figure 5:
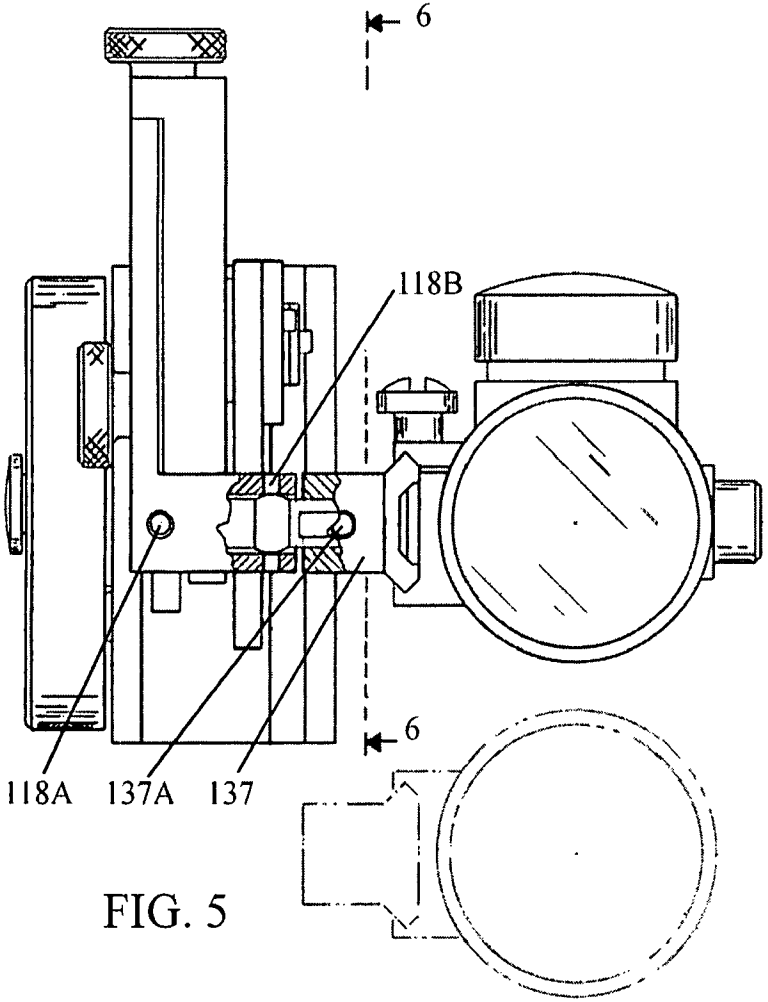
FIG. 5 is the right side view of FIG. 1 and an alternate position of the scope, in accordance with some embodiments.
Figure 7:
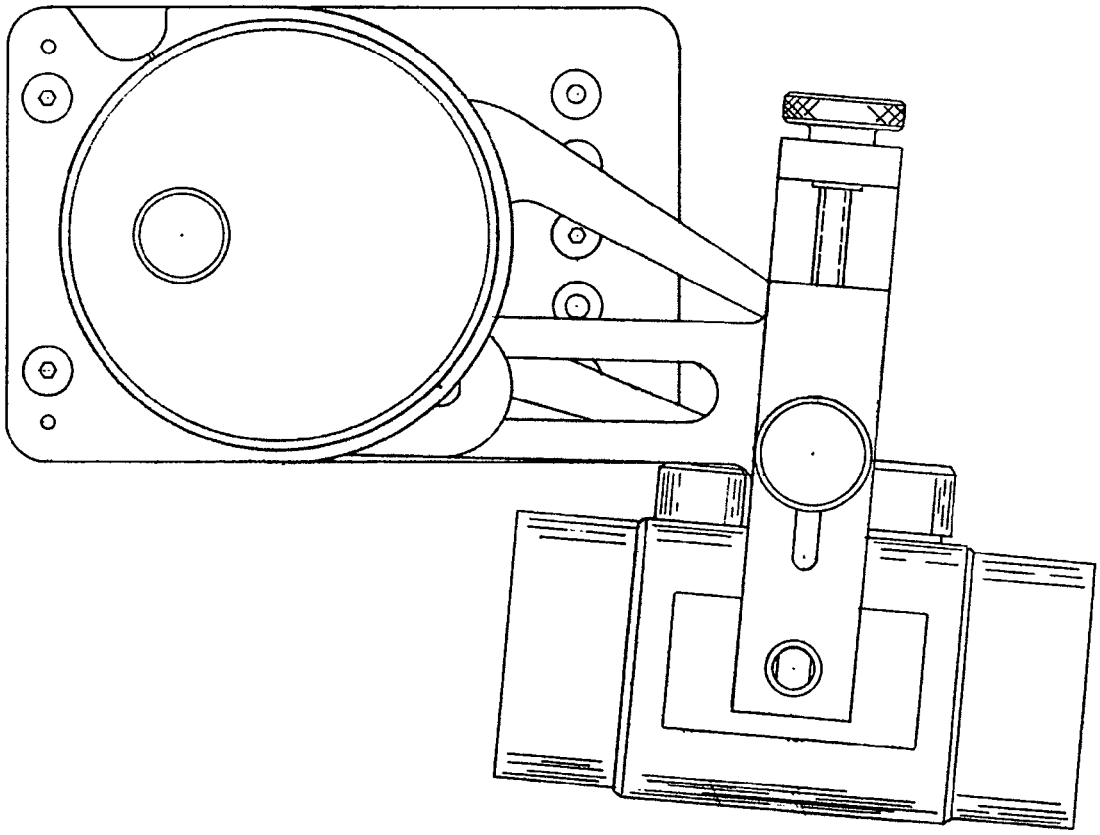
FIG. 7 is a plan view with applicable elements set at maximum range and the slide extended, in accordance with some embodiments.
Figure 8:
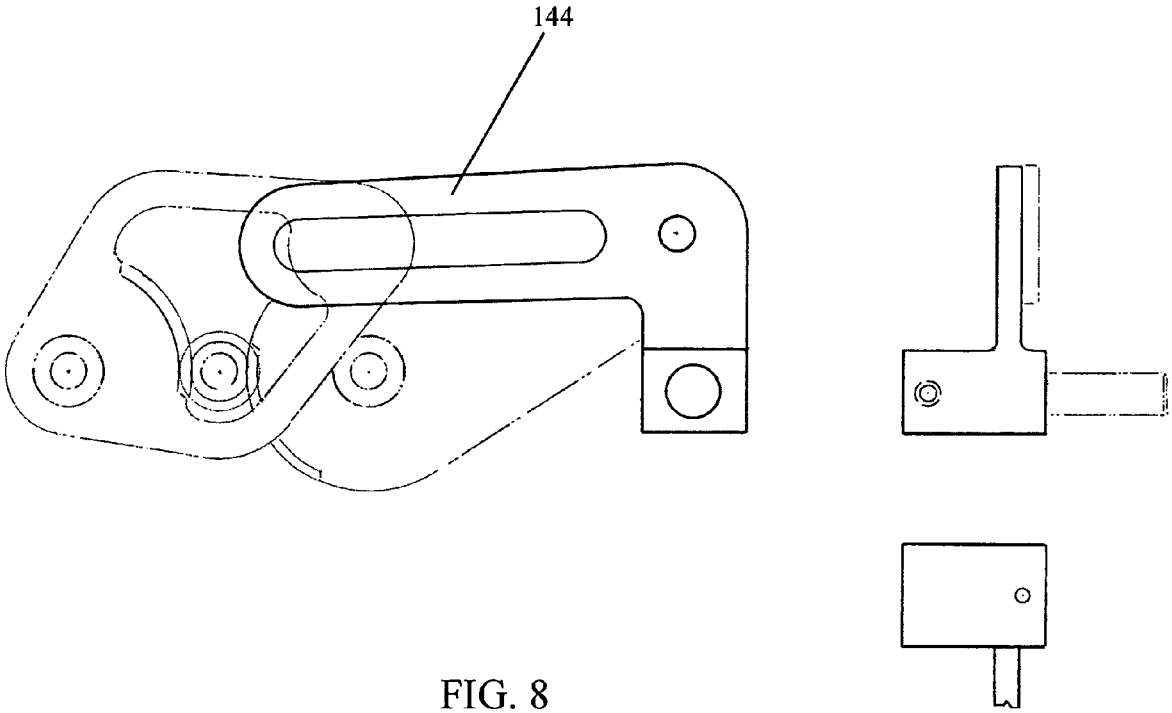
FIG. 8 is a diagram of the adjustable scope mount, in accordance with some embodiments.
Figure 9:
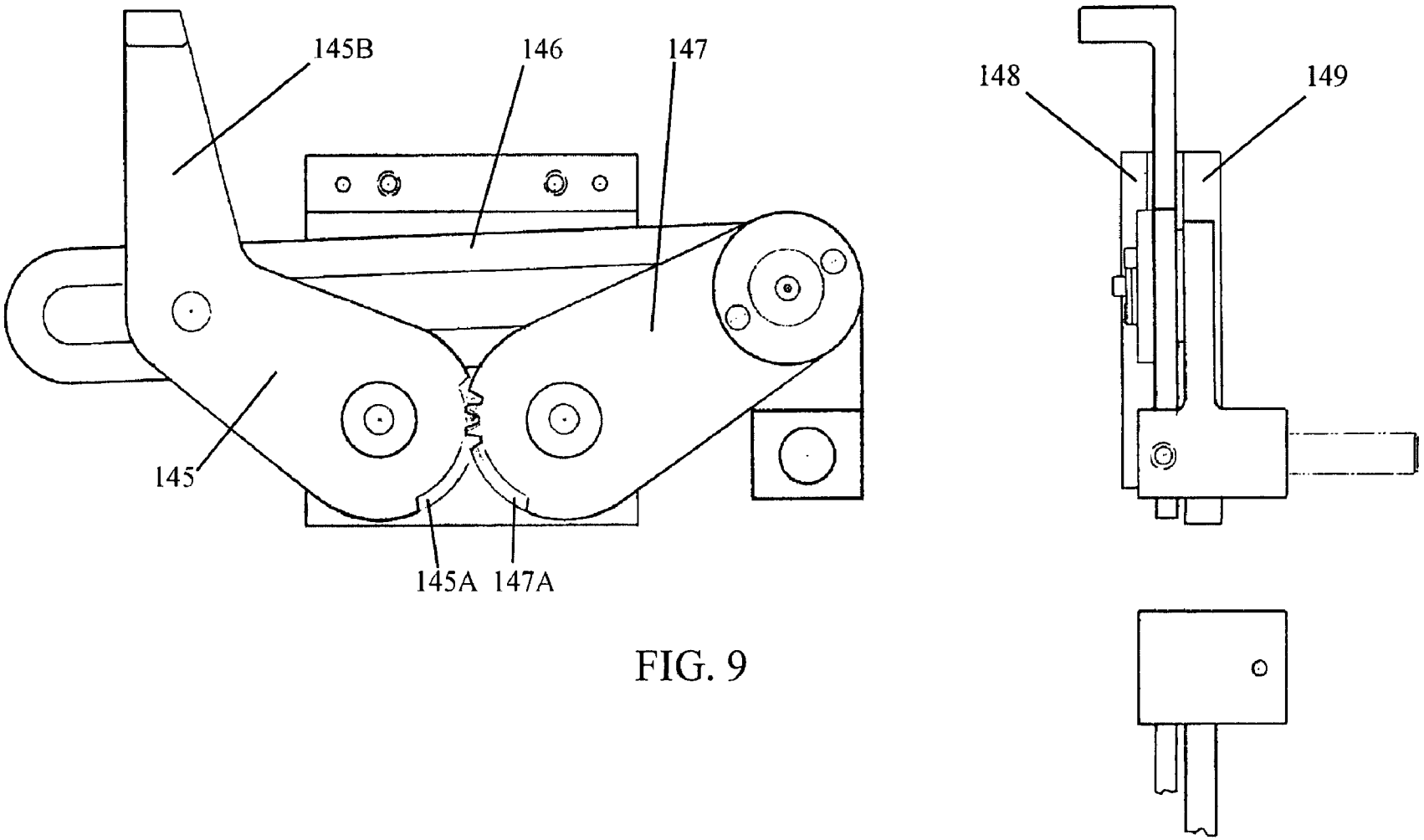
FIG. 9 is a diagram of the adjustable scope mount, in accordance with some embodiments.

The following elements may be constructed of materials appropriate for their function. Such materials may be steel, metal alloys, plastics, nylon, silicon, Delrin, Teflon, rubber, neoprene, and carbon fiber or a combination thereof. Referencing the diagrams in FIGS. 1-7, the base 100 provides a means to attach a plurality of related elements. The flat head screw 100A secures the base 100 to the bow adapter 104 by means of a double nut 141. The rear arm spacer 101 positioned on the rear arm pivot post 103 maintains appropriate working clearance between the base 100 and the rear arm 126. The rear arm bearing 102 is set in the rear arm 126 and provides for low pivotal friction between the rear arm 126 and the rear arm pivot post 103. The rear arm pivot post 103 is set in the base 100 and slip fits in the cover 136 and provides pivotal support to the rear arm 126. The bow adapter plate 104 provides means to attach the mount to a plurality of commercially available archery bows and further includes, 1) a vertical slot 104B allowing vertical adjustment of the base 100 and attaching the base by means of a flat head screw 104A and a double nut 141 slidably located in the slot 104B and 2) double horizontal slots 104C allowing horizontal displacement of the adapter plate to accommodate a plurality of bow configurations. The slots 104B and 104C may be substituted by a plurality of mounting holes. The double pinion base spacer 105 positioned on the small diameter end of the double pinion 107 maintains appropriate working clearance between the base 100 and the double pinion 107. The small double pinion bearing 106 is set in the base 100 and provides for low rotational friction for the small diameter end of double pinion 107.

The double pinion 107 comprises two connected but separated gears containing a plurality of pinion teeth 107A, a small diameter end engaging small double pinion bearing 106, a larger diameter opposite end engaging large double pinion bearing 133, and an extension of the larger diameter end providing means for attaching a hand knob 135. The separation of the two connected but separated gears of the double pinion 107 is consistent with the location of the front arm teeth 112A and the rear arm teeth 126A. The double pinion gears provide simultaneous and synchronized motion to the front arm 112 and the rear arm 126 by means of the double pinion gear teeth 107A simultaneously engaging the front arm teeth 112A and the rear arm teeth 126A. A front arm base spacer 108 positioned on the front arm pivot post 139 provides appropriate working clearance between the base 100 and front arm 112. A flat head screw 109 attaches to the slider post 127 and secures the slider post cap 110 to the stud. The slider post cap 110 retains the slider resilient washer 111 and the adjacent slider 124. The slider resilient washer 111 provides for continuous and controlled contact between the slider 124 and the slanted surfaces of the adjacent wedge slot 123B. The slider resilient washer 111 further provides for the controlled friction force between the elements so that it prevents unintentional movement of a plurality of connected moving parts but not high enough so that it prevents intentional movement of the parts. The front arm 112 oscillates through an arc of about 60 degrees. The front arm 112 provides a proportionally larger semicircular vertical oscillating motion to the front end of the link 123 by means of the offset housing post 121, an offset bearing 117, and an offset housing 113. The front arm 112 further includes a means to attach the offset housing 113, a front arm bearing 140, a plurality of the front arm teeth 112A, and a reference mark 112B. The teeth may be constructed of the same material and integral with the front arm 112 or may be of equal or dissimilar material and attached to the front arm 112. The offset housing 113 is attached to the distal end of the front arm 112 by a plurality of cap head screws 113A and provides for variable effective working length of front arm 112 by means of a plurality of offset mounting holes. The working length of the front arm 112 is effectively changed by removing said screws and turning the offset housing 113 such as any set of holes aligns with the pointer 112B. The mounting holes are offset in relation to the orifice of the offset housing bearing 117. The mounting holes may be substituted by two semicircular eccentric slots. The length variation alters the ratio in working length between the front arm 112 and the rear arm 126. The ratio change alters the elevation rate between front and rear section of the link 123. The rate change also alters line of sight cross over point and therefore draw length. The offset bearing post cap 114 retains the resilient washer 116 and the link 123 adjacent to the front arm 112.

The slide extension shaft 115 provides for slidably mounting of the scope adapter 137 and windage adjustment. The shaft further includes two opposite ends extending axially from a central truncated spherical section. The extensions have smaller diameter than the spherical section, set screw flats positioned strategically on each end, and a perpendicular orifice through the spherical section. A resilient washer 116 provides for controlled and continuous contact between the front arm 112, the front link spacer 122, and the link 123. The resilient washer 116 further provides controlled frictional force onto the offset housing 113 to prevent unintentional movement of a plurality of connected moving parts but not intentional movement. The offset housing bearing 117 is set in the offset housing 113 and provides for low pivotal friction between the offset housing post 121 and the front arm 112. The tower slide 118 provides for limited vertical movement of the extension shaft 115 as determined by length of slot 118C and attachment of the slide extension shaft 115 by means of an orifice of slightly larger diameter than the truncated spherical feature of the shaft and the extension shaft pin 118B. The pin has an interference fit in tower slide 118 and slip fits in the extension shaft 115. The slip fit provides for free lateral movement of the extension shaft 115 by means of set screws 118A. The set screws 118A also provide a lateral locking mechanism for the extension shaft 115. The lateral movement of the slide extension shaft 115 provides for windage adjustment. The tower slide lock 119 provides for the locking of the tower slide 118 once the vertical position is determined. The slide thumbscrew 120 provides precise motion to the tower slide 118. The retainer 120A retains the slide thumb screw 120 captive to the link tower 123A. The offset housing post 121 is set in the link 123 and provides pivotal support to the front arm 112 through the offset bearing 117 and a means for cap screw 121A which retains the resilient washer 116. The front link spacer 122 positioned on the offset housing post 121 provides appropriate working clearance between the front arm 112 and the link 123. The link 123 further includes the link tower 123A and the wedge slot 123B. The link 123 provides a bridge between the front arm 112 and the rear arm 126. The link tower 123A further includes a means for slidably mounting the tower slide 118, the tower slide lock 119, the slide thumb screw 120, and the offset housing post 121.

The wedge slot 123B provides for slidably mounting a wedge slider 124. The tilting of the link 123 is directly proportional to the vertical difference in oscillating height between the front and rear arms. The difference results in variable distances between the housing post 121 and the slider post 127. The difference may be the product of the arms working lengths, gear ratios, or combinations thereof. The degree of tilting determines the lines of sight cross over point in the direction of the archer and the elevation in the direction of the target. The cross over point equates to the normal position of the archer's eye while the archer maintains proper stance and full draw at a constant anchor point. Most modern compound bows are manufactured with draw lengths from about 25 inches to 33 inches. The elevation is relevant to distance and trajectory. A modern compound bow delivers an arrow at a bow speed of about 300 feet per second. A modern average arrow, when propelled at that speed, will have a trajectory of about 14 feet when the arrow is aimed at a target 70 yards distant. The wedge slider 124 provides for the slidable retention of the adjacent link 123. The sliding feature is required to allow for the back or forth displacement of the link 123 as the front arm length is adjusted for draw length by the offset housing 113 and for the cyclical horizontal back and forth displacement of the link 123 in relation to the slider post 127. The variable distance is proportional to the difference in arc length between the front arm 112 and the rear arm 126. The rear link spacer positioned on the slider post 127 provides working clearance between the link 123 and the rear arm 126. The rear arm 126 oscillates through an arc of about 60 degrees. The rear arm arc is proportionally smaller than that of the front arm 112 and provides a proportionally shorter semicircular vertical oscillating motion to the rear end of the link 123 by means of the slider post 127 and the slider 124. The arm comprises a rear arm bearing 102, the slider post 127, and a plurality of rear arm teeth 126A. The teeth may be constructed of the same material and integral with the front arm 126 or may be of equal or dissimilar material and attached to the arm. The slider post 127 is set in the rear arm 126 and provides for the pivotal motion of the slider 124, a means for securing slider cap 110, and a means for the flat head screw 109. The lock resilient washer 128 provides for mar free, cushioned, and high friction contact with the frame 136. The hand knob lock 129 provides for locking the hand knob 135 at a specific location. As the hand lock is rotated clockwise it moves forward causing the resilient washer to make contact with the cover 136 thus providing for high friction and effectively stopping motion of the hand knob 135. The locking feature may be selected by archer when a plurality of shots are taken at any given time such as during target shooting. The back up plate 130 distributes force and transfers forward motion of the hand knob lock 129 on to the resilient washer 128.

The double pinion cover spacer 131 positioned on the large diameter end of the double pinion 107 provides working clearance between the cover 136 and the double pinion 107. The hand knob spacer 132 positioned on the extended large diameter of the double pinion 107 provides for working clearance between the hand knob 132 and the cover 136. The large double pinion bearing 133 set in the cover 136 provides low rotational friction between the double pinion 107 and the cover 136. The rear arm cover spacer 134 positioned on the rear arm pivot post 103 provides working clearance between the cover 136 and the rear arm 126. The hand knob 135 provides rotational movement to the double pinion 107 by means of the archer's hand. The hand knob further includes a set screw 135A which secures the hand knob 135 to the double pinion 107 and a graduated scale 135B which provides a means for an archer to set previously established range settings. The cover 136 provides for the mounting of a plurality of elements and further includes an elevation window 136C further including a groove 136E which provides a reference for aligning previously recorded range settings a means for the hand knob lock 129 to lock the hand knob 135, a means for stopping the hand knob 135 rotation by means of a semicircular slot 136A and a dowel pin 136D which provides for accurate reassembly of the cover 136 onto the base 100. The scope adapter 137 provides for a Weaver type base for mounting a plurality of commercially available scopes. The adapter further includes set screws 137A so that the scope adapter may be locked in position onto the slide extension shaft 115.

The scope 138 provides for optically aligning the target to an archer's eye. The scope may be a long eye relief pistol type scope which may provide for magnification or a reflex type usually non-magnified. The reflex type utilizes optical collimators to reflect a luminous or reflective reticle. The reticle may be of a plurality of colors while red is predominant. The scope and reflex sights are commercially available in a multiplicity of configurations. The front arm pivot post 139 is set in the frame 100 and provides pivotal support to the front arm 112. The retainer ring 139A provides for the retention of the front arm 112. The front arm bearing 140 is set in the front arm 112 and provides for the low pivotal friction between the front arm 112 and the front arm pivot post 139. The double nut 141 slides in vertical slot 104B and provides, in conjunction with the screw 100A, for securing the base 100 at any point within the confine of the slot to the bow adapter plate 104. The elongated screw adapter 142 provides the screw 104A slidably on the horizontal slot 104C and the bow 143, a commercially available devise used to propel arrows. The configuration of the bow may be a longbow, decurve, recurve, or compound.

In some embodiments, an adjustable archery bow sight mount for use on an archery bow utilizes handgun type scopes or reflex sights. The mount comprises a bow adapter plate configured to adapt to a plurality of bows and provide a means for attaching a base. The base is configured to accept a plurality of elements and has a semicircular slot configured to accept a stop pin and a window that incorporates a means to set individual ranges and a Weaver type scope adapter configured to accept scopes with integral or attached Weaver type rails. The scope adapter has a hollow extension configured to mount onto an extension shaft. The mount also comprises a precision tower slide to fine tune the initial scope alignment with an archer's eye. The slide provides a means for windage adjustment. The mount also comprises a locking mechanism for the slide, two in line forward mounted oscillating arms with integral gear teeth. The arms provide a means for mounting a linkage and are mounted such as one is forward of the other and the forward arm oscillates through a greater arc. The forward arm has a means for draw length adjustment. The link bridges the distal ends of the arms. A double pinion gear provides synchronized motion to the arms. A hand knob attached to the gear provides a means for an archer to manipulate the pinion, prevent unwanted motion, and a graduated elevation scale.

In another embodiment, the link is a simple link that provides for an extension shaft. This embodiment provides for a simpler and more economical mount by deleting the fine adjustability provided by tower slide and link tower as well as associated elements as described in the previous embodiment.

In yet another embodiment, two operating arms facing opposite each other are coupled together with a long link which provides for an extension shaft. The two arms comprise geared portions that make direct contact between their respective teeth, thus precluding the use of a double pinion. Motion to the arm is provided by an archer directly moving on an extension of the rear arm.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

I claim:

1. An archery bow sight mount, comprising:

a base;

a double pinion comprising a first gear and a second gear wherein the double pinion is rotatably attached to the base;

a first arm rotatably attached to the base wherein the first arm comprises a gear tooth portion coupled to the first gear of the double pinion;

a second arm rotatably attached to the base wherein the second arm comprises a gear tooth portion coupled to the second gear of the double pinion and wherein the length of the second arm is less than the length of the first arm;

a link rotatably attached to a first arm and slidably attached to the second arm; and a scope mount attached to the link.

2. The archery bow sight mount of claim 1, further comprising a plate configured to adapt to a bow, wherein the base is attached to the plate.

3. The archery bow sight mount of claim 2, wherein the plate is configured to adapt to a plurality of bows.

4. The archery bow sight mount of claim 1, wherein the scope mount comprises a vertical adjustment.

5. The archery bow sight mount of claim 1, wherein the scope mount comprises a windage adjustment.

6. The archery bow sight mount of claim 1, further comprising a scope attached to the scope mount.

7. The archery bow sight mount of claim 6, wherein the scope comprises at least one of: a long eye relief scope, a magnified long eye relief scope, and a reflex sight.

8. The archery bow sight mount of claim 1, wherein the link is rotatably attached to an offset housing attached to the first arm wherein the offset housing provides an adjustment for draw length.

9. The archery bow sight mount of claim 1, further comprising a hand knob attached to the double pinion.

10. The archery bow sight mount of claim 9, wherein the hand knob comprises a graduated elevation scale and a stop pin.

11. An archery bow sight mount, comprising:

a base;

a first arm rotatably attached to the base wherein the first arm comprises a gear tooth portion;

a second arm rotatably attached to the base wherein the second arm comprises a gear tooth portion wherein the gear tooth portion of the second arm is coupled to the gear tooth portion of the first arm;

a link rotatably attached to a first arm and slidably attached to the second arm; and a scope mount attached to the link.

12. The archery bow sight mount of claim 11, further comprising a plate configured to adapt to a bow, wherein the base is attached to the plate.

13. The archery bow sight mount of claim 12, wherein the plate is configured to adapt to a plurality of bows.

14. The archery bow sight mount of claim 11, wherein the scope mount comprises a vertical adjustment.

15. The archery bow sight mount of claim 11, wherein the scope mount comprises a windage adjustment.

16. The archery bow sight mount of claim 11, further comprising a scope attached to the scope mount wherein the scope comprises at least one of: a long eye relief scope, a magnified long eye relief scope, and a reflex sight.

17. The archery bow sight mount of claim 11, wherein the link is rotatably attached to an offset housing attached to the first arm wherein the offset housing provides an adjustment for draw length.

* * * * *